United States Patent [19]

Leung et al.

[11] Patent Number: 4,795,940

[45] Date of Patent: Jan. 3, 1989

[54] LARGE AREA DIRECTLY HEATED LANTHANUM HEXABORIDE CATHODE STRUCTURE HAVING PREDETERMINED EMISSION PROFILE

[75] Inventors: Ka-Ngo Leung, Hercules; Keith C. Gordon, Berkeley; Dean O. Kippenham, Castro Valley; Peter Purgalis; David Moussa, both of San Francisco; Malcom D. Williams, Danville; Stephen B. Wilde, Pleasant Hill; Mark W. West, Albany, all of Calif.

[73] Assignee: The United States of America as represented by the United States Department of Energy, Washington, D.C.

[21] Appl. No.: 108,327

[22] Filed: Oct. 14, 1987

[51] Int. Cl.[4] ..... H01J 1/14; H01J 1/16; H01J 19/10

[52] U.S. Cl. ..... 313/346 R; 313/351; 313/356; 313/341; 313/51

[58] Field of Search ..... 313/346 R, 336, 341, 313/343, 351, 356, 337, 49, 51, 45

[56] References Cited

U.S. PATENT DOCUMENTS

| | | | |
|---|---|---|---|
| 3,617,687 | 11/1971 | Katawoka | 313/351 X |
| 4,054,946 | 10/1977 | Ferris et al. | 313/346 R |
| 4,258,283 | 3/1981 | Brunger et al. | 313/336 |
| 4,346,325 | 8/1982 | Nakasuji et al. | 313/336 |
| 4,363,995 | 12/1982 | Takigawa et al. | 313/346 R |
| 4,468,586 | 8/1984 | Hohn | 313/336 |
| 4,486,684 | 12/1984 | Hohn | 313/336 |
| 4,528,474 | 7/1985 | Kim | 313/346 R |
| 4,585,971 | 4/1986 | Clegg | 313/343 X |
| 4,675,573 | 6/1987 | Miram et al. | 313/337 X |

FOREIGN PATENT DOCUMENTS

| | | | |
|---|---|---|---|
| 51438 | 3/1983 | Japan | 313/336 |

OTHER PUBLICATIONS

Directly Heated Lanthanum Hexaboride Cathode; Sci. Instrum.; 4/3/86; Leung et al.; pp. 1274–1276.

Directly Heated $LaB_6$ Cathodes for Ion Source Operation; Vacuum; 11/12/86; Leung; vol. 36, pp. 865–867.

Lanthanum Hexaboride Tapered Filament in a Plasma Ion Source Rev. Sci. Instrum.; Pincosy et al.; pp. 655–658; 1/14/85.

Directly Heated Lanthanum Hexaboride Filaments; Rev. Sci. Instrum.; 3/14/84; Leung et al.; pp. 1064–1068.

*Primary Examiner*—David K. Moore
*Assistant Examiner*—Michael Horabik
*Attorney, Agent, or Firm*—L. E. Carnahan; Roger S. Gaither; Judson R. Hightower

[57] ABSTRACT

A large area directly heated lanthanum hexaboride ($LaB_6$) cathode system (10) is disclosed. The system comprises a $LaB_6$ cathode element (11) generally circular in shape about a central axis. The cathode element (11) has a head (21) with an upper substantially planar emission surface (23), and a lower downwardly and an intermediate body portion (26) which diminishes in cross-section from the head (21) towards the base (22) of the cathode element (11). A central rod (14) is connected to the base (22) of the cathode element (11) and extends along the central axis. Plural upstanding spring fingers (37) are urged against an outer peripheral contact surface (24) of the head end (21) to provide a mechanical and electrical connection to the cathode element (11).

14 Claims, 1 Drawing Sheet

FIGURE 1
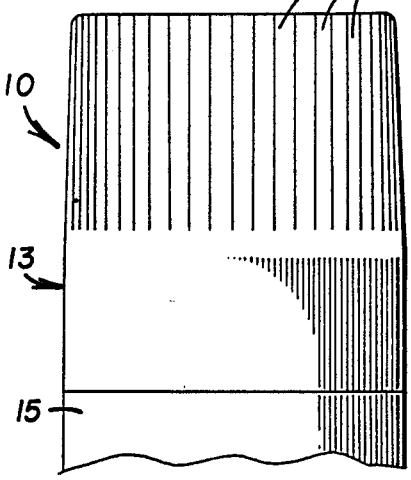
FIGURE 2
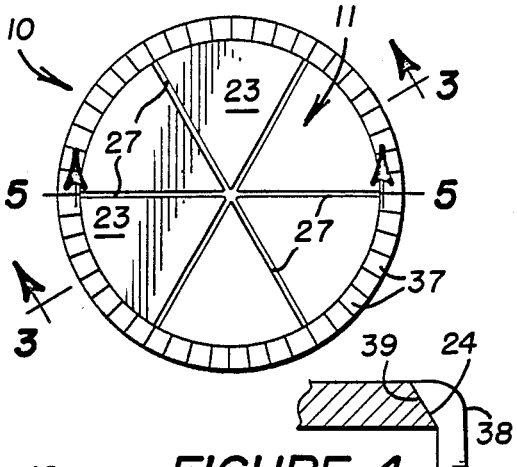
FIGURE 4
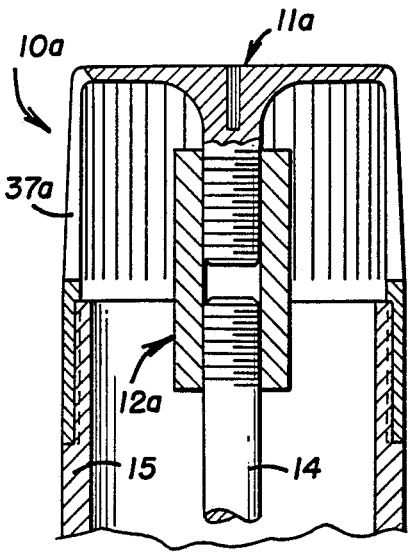
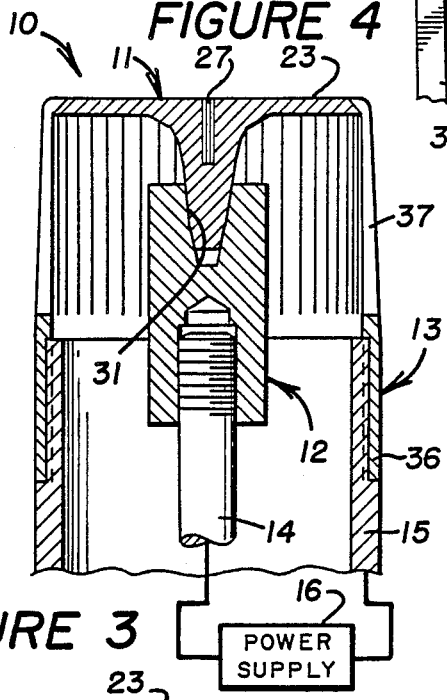
FIGURE 6
FIGURE 3
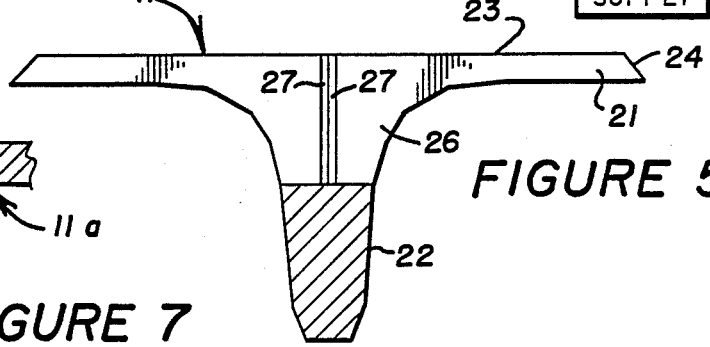
FIGURE 5
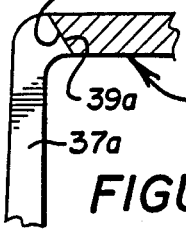
FIGURE 7

LARGE AREA DIRECTLY HEATED LANTHANUM HEXABORIDE CATHODE STRUCTURE HAVING PREDETERMINED EMISSION PROFILE

BACKGROUND OF THE INVENTION

The present invention relates to lanthanum hexaboride cathodes and more particularly to lanthanum hexaboride cathodes having a large area emission surface and which are directly heated. The United States Government has rights in this invention pursuant to Contract No. DE-AC03-87SF00098 between the U.S. Department of Energy and the University of California.

It has been known for some time that lanthanum hexaboride ($LaB_6$) is a good material for use as an electron emitter. It has unusual physical properties such as high melting point, chemical inertness, low work function, high brightness of emission current, and it resists erosion under ion bombardment. When heated to a temperature of 1600 K or higher, $LaB_6$ is a copious emitter of electrons. For these reasons $LaB_6$ cathodes are widely used in many branches of modern technology such as electron microscopes, mass spectroscopy, demountable vacuum gauges and thermionic converters.

In most of these applications, $LaB_6$ is operated as an indirectly heated cathode, either in the form of a small crystal structure or as a sintered material in some geometric form with a heater behind it.

Many applications in modern technology, such as high-power, free electron lasers, require the emission of intense electron beams and large area cathodes capable of high emission current densities. Indirectly heated $LaB_6$ disks, with a relatively large planar emission surface have been tried. However, such disks are very difficult to heat uniformly. $LaB_6$ has a high coefficient of thermal expansion and the non-uniform heating of such disks cause rapid failures thereof.

Long slender $LaB_6$ filaments, in a hairpin configuration and heated by passage of current directly therethrough have been proposed. The hairpin configuration allows free expansion and contraction of the filament similar to regular tungsten hairpin filaments, and this overcomes much of the thermal failure of $LaB_6$ disks. However, the total emission surface of such $LaB_6$ filaments is relative small. If plural filaments are used to obtain a high current emission, the physical space between the cathodes, and also between the hairpin legs thereof, will spread the emission over a relatively large area, thus reducing the intensity of the emitted beam.

SUMMARY OF INVENTION

It is the principle object of the invention to provide a $LaB_6$ cathode which has a large area emission surface and which can have uniform emission from such surface to thereby provide high emission with high current density.

It is a further object of the invention to provide a large area emission surface $LaB_6$ cathode in which a predetermined emission profile can be easily machined into the cathode to enable use of the cathode as an active focusing element.

Additional objects, advantages, and novel features of the invention will be set forth in the description which follows, and in part will become apparent to those skilled in the art upon examination of the following, or may be learned by practice of the invention. The objects and advantages of the invention may be realized by means of the instrumentalities and combinations pointed out in the appended claims.

To achieve the foregoing and other objects, and in accordance with the invention, as described and broadly claimed herein, a lanthanum hexaboride ($LaB_6$) cathode system is provided, in which a $LaB_6$ cathode element is generally circular in shape about a central axis and has a head and a base at opposite ends of the control axis, the head end having a generally planar emission surface extending radially from the axis, the cathode element also having an intermediate body diminishing in cross-section area from the head towards the base, and means for directly heating the cathode element.

A further aspect of the invention lies in the use of an electrical connector in the shape of a collar coaxial with the central axis of the cathode element, with a plurality of spring fingers extending from the collar generally parallel to the central axis, the spring fingers having tips thereon which are in electrical contact with the head end of the cathode element around the periphery thereof.

Yet another aspect of the invention lies in the radial segmentation of the head of the cathode element which reduces stresses from thermal expansion.

BRIEF DESCRIPTION OF THE DRAWINGS

The accompanying drawings, which are incorporated in and form part of the application, together with the description, serve to explain the principles of the invention.

FIG. 1 is a side view of the $LaB_6$ cathode system constructed in accordance with the present invention.

FIG. 2 is an end view of the $LaB_6$ cathode system of FIG. 1.

FIG. 3 is a sectional view of the $LaB_6$ cathode system of FIG. 2, taken on line 3—3 thereof.

FIG. 4 is an enlarged detail view, of a portion of FIG. 3 showing the engagement of the spring fingers with the head of the cathode element.

FIG. 5 is a sectional view of the $LaB_6$ cathode element, taken on line 5—5 of FIG. 2.

FIGS. 6 and 7 are views, similar to FIGS. 3 and 4, of an alternative form of $LaB_6$ cathode system.

DESCRIPTION OF PREFERRED EMBODIMENTS

Referring to the drawings, wherein preferred embodiments of the invention are shown, and in particular to FIGS. 1–5, wherein a first embodiment is shown, the $LaB_6$ cathode system 10 comprises a $LaB_6$ cathode element 11, first and second electrical connectors 12 and 13, inner and outer conductors 14 and 15, and a power supply 16 connected to conductors 14 and 15.

The $LaB_6$ cathode element 11 is generally circular in shape about its central axis and has a head 21 and a base 22 at opposite ends of its central axis. The head 21 has a generally planar emission surface 23, and an outer peripheral contact surface 24 inclined downwardly and outwardly from the emission surface 23. The cathode element 11 also has an integral, axially-elongated, tapered intermediate body 26 extending along the central axis of the cathode element 11 and between its head 21 and its base 22 with a progressively diminishing cross-sectional area towards the base. The body 26 is particularly shaped for the purposes more fully described later on herein. The head 21 has a plurality of radially extending vertical cuts 27 therethrough, dividing the head into a plurality of segments, to reduce mechanical stresses resulting from thermal expansion or contraction of the cathode element 11. The number of vertical cuts will be determined by the size of the cathode element. A $LaB_6$ cathode element one inch in diameter may function satisfactorily with no cuts at all, i.e. with the head as a single solid element, whereas six cuts, with six head end segments, have been used with a two inch diameter $LaB_6$ cathode element to provide the desired stress relief. Larger diameter cathode elements will require more head segmentation.

The electrical connector 12 has a tapered socket 31 to receive the tapered base 22 of the cathode element therein. Since $LaB_6$ attacks metals such as copper or molybdenum, the electrical connector 12 is preferably made of graphite. The opposite end of connector 12 is preferably threaded for connection to conductor 14. Conductor 14 is preferably a copper rod and is electrically connected to one side of the power supply 16.

The other electrical connector 13, also preferably made of graphite, includes a collar 36 threaded on the tubular copper conductor 15, the connector 13 and conductor 14 both being coaxial to the cathode element 11. The connector 13 also includes a plurality of spring fingers 37 extending from the collar 36 generally parallel to the central axis of the cathode element 11. The tips 38 of the spring fingers 37 have inclined surfaces 39 in electrical and mechanical engagement with the inclined contact surface 24 on the cathode element around the periphery of the head 21 thereof.

The manufacture of solid lanthanum hexaboride is normally accomplished by sintering of $LaB_6$ particles under various temperatures and pressure to obtain the desired material density. In principle, the maximum obtainable density is 4.7 grams per cubic centimeter. Densities ranging from 60% to 95% of this value are readily available with 80%–85% densities being the most common off-the-shelf material available. Higher densities can be produced, but at a higher manufacturing costs. $LaB_6$ material with density lower than 60% is quite soft and structurally weak, and therefore is not suitable for cathode use. For high densities, $LaB_6$ has ceramic-like properties in hardness and requires special tooling and techniques for machining.

The cathode element is made from a sintered cylinder of $LaB_6$ material having a diameter at least as large as the final desired diameter of the head 21 of the cathode element. The cylinder is then machined, as by diamond grinding, to shape the emission surface 23, the contact surface 24, tapered surface 26 and base 22 as shown in the drawings. The radial cuts 27 are preferably made by wire cut electric discharge machining.

In order to provide uniform electron emission, the emission surface 23 must be uniformly heated throughout its area. Since the cathode element 11 is directly heated by the current passing therethrough, the thickness of the head 21 and the shape of the tapered body 26 are particularly chosen to provide substantially uniform heating throughout the cathode element when the cathode is emitting from its emission surface.

In operation, both heater current $I_h$ and emission current $I_e$ enter the periphery of the head end of the cathode element 11 from the spring fingers 37 of the connector 13. Part of the total current is emitted ($I_e$) from the emission surface 23, while the remainder ($I_h$) of the current leaves the cathode element by way of the connector 12 and central conductor 14. In a typical operation with a two inch diameter $LaB_6$ cathode element 11, the power supply may be $1\frac{1}{2}$ volts dc with the total current entering the cathode element being in the order of 1,000 amperes. Such current flow can heat the cathode element to about 2,000 K, and the emission current will be in the order of 25 amperes/square centimeters, with a total emission current of approximately 500 amperes.

Because the total current enters the cathode element 11 from around the periphery thereof, the emission current flow will be primarily in a radial direction throughout the head 21 of the cathode element, while the heater current portion of the total current will have radial and axial components of flow direction through the cathode element. Since the total current flow through the cathode element decreases considerably towards the base, the body 26 of the cathode element is tapered to provide a diminishing cross-section through which the decreased amount of total current flows. The exact geometrical shape of the cathode element is determined by balancing the ohmic heating, throughout the volume of the cathode element as the total current flow decreases from the head to the base, with the large degree of radiant cooling produced by the emission current leaving the emission surface 23, and also with the heat conduction from the head and base of the cathode element to the graphite connectors 12 and 13, so that there is substantially uniform heating throughout the volume of the cathode element.

The configuration of the disclosed cathode system is also advantageous in that the magnetic fields produced by current flow are minimized. The magnetic fields produced by the flow of heater current in the conductor 15 and connector 13 are in equal and opposite directions to the fields produced by the heater current flow in the connector 12 and conductor 14, so that these magnetic fields cancel each other. The radial current flow through the cathode element, between the periphery of the cathode element and its central axis, likewise results in a zero net magnetic field at the emission surface.

The present invention is also advantageous in that the large area emission surface 23 of the cathode element may be used as part of the overall focusing structure that would be used to provide a desired electron beam.

For example, the "substantially planar" emission surface 23 may be machined perfectly planar, or with a small degree of concavity, as desired, to produce with focusing electrodes (not shown) the desired electron beam at a distant target.

The embodiment of the invention shown in FIGS. 1–5 is a "push" type embodiment, wherein the cathode element 11 is held in place by pushing the downwardly and outwardly inclined contact surface 24 against the inclined surfaces 39 of the spring finger 37. These mating inclined surfaces will maintain the cathode element in place axially while allowing for radial thermal expansion and contraction of the cathode head.

If desired, the cathode system may be made as a "pull" type embodiment **10*a*, wherein the contact surface 24*a* on the head end of the cathode element 11*a* is downwardly and inwardly inclined and the ends of the spring fingers 37*a* have inclined surfaces 39*a* complementary thereto. In this embodiment, the cathode element 11*a* is held in place relative to the spring fingers 37*a* by a downward pulling force on the cathode element. In order to resist this force, the base of the cathode element 11*a* should be machined with threads or an equivalent structure so that cathode element 11a can be mechanically secured to the graphite connector 12a**.

The foregoing description of the preferred embodiments have been presented for the purposes of illustration and description. It is not intended to be exhaustive or to limit the invention to the precise features described, and obviously many modifications and variations are possible in light of the above teaching. The embodiments were shown in order to explain most clearly the principles of the invention and the practical applications thereby to enable others in the art to utilize most effectively the invention in various other modifications as may be suited to the particular use contemplated. It is intended that the scope of the invention be defined by the claims appended hereto.

What is claimed is:

1. A directly heated lanthanum hexaboride cathode system comprising:

a lanthanum hexaboride cathode element generally circular in shape about a central axis and having a head and base at opposite ends of a said central axis, said head end having a generally planar emission surface extending radially from said axis and an outer peripheral contact surface, said cathode element having an integral, axially-elongated, tapered, intermediate body extending along said central axis between said head to said base, said intermediate body having a progressively diminishing cross-section from said head towards said base, a first electrical connector in conducting engagement with and peripherally around said contact surface on said head of said cathode element, a second electrical connector in conducting engagement with said base of said cathode element, means for establishing a flow of electrical current from one of said electrical connectors through said cathode element to the other of said electrical connectors.

2. A directly heated lanthanum hexaboride cathode system as set forth in claim 1, wherein said first electrical connector comprises a collar coaxial with said cathode element, said first electrical connector having a plurality of spring fingers extending from said collar generally parallel to said central axis of said cathode element, said spring fingers having tips thereon in electrical contact with said contact surface on said head end of said cathode element around the periphery thereof.

3. A directly heated lanthanum hexaboride cathode system as set forth in claim 2, wherein said first and second electrical connectors are concentric and coaxial with said central axis of said cathode element.

4. A directly heated lanthanum hexaboride cathode system as set forth in claim 3, wherein said outer peripheral contact surface on said head of said cathode element is inclined toward said emitting surface thereof, and wherein said tips of said spring fingers have inclined surfaces in engagement with said inclined peripheral contact surface.

5. A directly heated lanthanum hexaboride cathode system as set forth in claim 4, wherein said outer peripheral contact surface is inclined downward and outwardly from said emission surface.

6. A directly heated lanthanum hexaboride cathode system as set forth in claim 4, wherein said outer peripheral contact surface is inclined downwardly and inwardly from said emission surface.

7. A directly heated lanthanum hexaboride cathode system as set forth in claim 1 wherein said head of said cathode element has a plurality of radial cuts therethrough.

8. A directly heated lanthanum hexaboride cathode system as set forth in claim 7, wherein said first electrical connector comprises a collar coaxial with said cathode element, said first electrical connector having a plurality of spring fingers extending from said collar generally parallel to said central axis of said cathode element, said spring fingers having tips thereon in electrical contact with said contact surface of said head of said cathode element around the periphery thereof.

9. A directly heated lanthanum hexaboride cathode system as set forth in claim 8, wherein said first and second electrical connectors are concentric and coaxial with said central axis of said cathode element.

10. A directly heated lanthanum hexaboride cathode system as set forth in claim 9, wherein said outer peripheral contact surface on said head of said cathode element is inclined toward said emission surface thereof, and wherein said tips of said spring fingers have inclined surfaces in engagement with said inclined peripheral contact surface.

11. A directly heated lanthanum hexaboride cathode system as set forth in claim 10, wherein said outer peripheral contact surface is inclined downward and outwardly from said emission surface.

12. A directly heated lanthanum hexaboride cathode system as set forth in claim 10, wherein said outer peripheral contact surface is inclined downwardly and inwardly from said emission surface.

13. A directly heated lanthanum hexaboride cathode system comprising:

a lanthanum hexaboride cathode element generally circular in shape about a central axis and having a head and base at opposite ends of said central axis, said head end having a generally planar emission surface extending radially from said axis and an outer peripheral contact surface, said cathode element having an integral, axially-elongated, tapered intermediate body extending along said central axis from said head to said base, said intermediate body having a diminishing cross-section from said head towards said base, said cathode element being shaped to provide substantially uniform heating throughout said cathode element when said cathode element is emitting from its emission surface, a first electrical connector in conducting engagement with and peripherally around said contact surface on said head of said cathode element, a second electrical connector in conducting engagement with said base of said cathode element, means for establishing a flow of electrical current from one of said electrical connectors through said cathode element to the other of said electrical connectors.

14. A directly heated lanthanum hexaboride cathode system as set forth in claim 13 wherein said head of said cathode element has a plurality of radial cuts therethrough.

* * * * *